US008476876B2

(12) United States Patent
Liu

(10) Patent No.: US 8,476,876 B2
(45) Date of Patent: Jul. 2, 2013

(54) VOLTAGE-MODULATED CIRCUIT DEVICE TO FORM ELECTRIC POWER WITH STEPPED-DOWN VOLTAGE

(76) Inventor: Ta-I Liu, Taipei (TW)

( * ) Notice: Subject to any disclaimer, the term of this patent is extended or adjusted under 35 U.S.C. 154(b) by 347 days.

(21) Appl. No.: 12/844,772

(22) Filed: Jul. 27, 2010

(65) Prior Publication Data

US 2012/0025798 A1 Feb. 2, 2012

(51) Int. Cl.
*G05F 1/613* (2006.01)
*G05F 1/652* (2006.01)
*G05F 1/648* (2006.01)

(52) U.S. Cl.
USPC ..... 323/223; 323/233; 323/297

(58) Field of Classification Search
USPC ..... 323/223, 226, 233, 297, 298; 327/538, 327/541, 543
See application file for complete search history.

(56) References Cited

U.S. PATENT DOCUMENTS 4,364,006 A * 12/1982 Makabe et al. ..... 323/353
7,619,402 B1 * 11/2009 Kwong ..... 323/369
7,965,065 B2 * 6/2011 Hirota ..... 323/233
2002/0130645 A1 * 9/2002 Tsai et al. ..... 323/274
2007/0008009 A1 * 1/2007 Son et al. ..... 326/87
2008/0164854 A1 * 7/2008 Lys ..... 323/226
2008/0169870 A1 * 7/2008 Yamamoto et al. ..... 327/543
2009/0295462 A1 * 12/2009 Itoh ..... 327/525
2010/0073032 A1 * 3/2010 Abe et al. ..... 327/50

* cited by examiner

*Primary Examiner* — Adolf Berhane
*Assistant Examiner* — Fred E Finch, III
(74) *Attorney, Agent, or Firm* — Chun-Ming Shih

(57) ABSTRACT

A voltage-modulated circuit device uses a power source of a modulation circuit to acquire a predetermined trigger voltage through a voltage acquisition circuit and a step-down circuit to step down a voltage, and then a voltage amplification circuit amplifies the voltage by several times, such that the trigger voltage amplified by several times still falling within the range of predetermined voltage values triggers and conducts a switch circuit, and the power source of the modulation circuit can flow from an anode to a cathode in order to supply an electric power with a step-down voltage. With the design of triggering the conduction, the voltage of the modulation circuit can be modulated automatically to maintain the electric power supplied to the circuit device within the range of required voltage values, only if the trigger voltage has the predetermined voltage value.

2 Claims, 1 Drawing Sheet

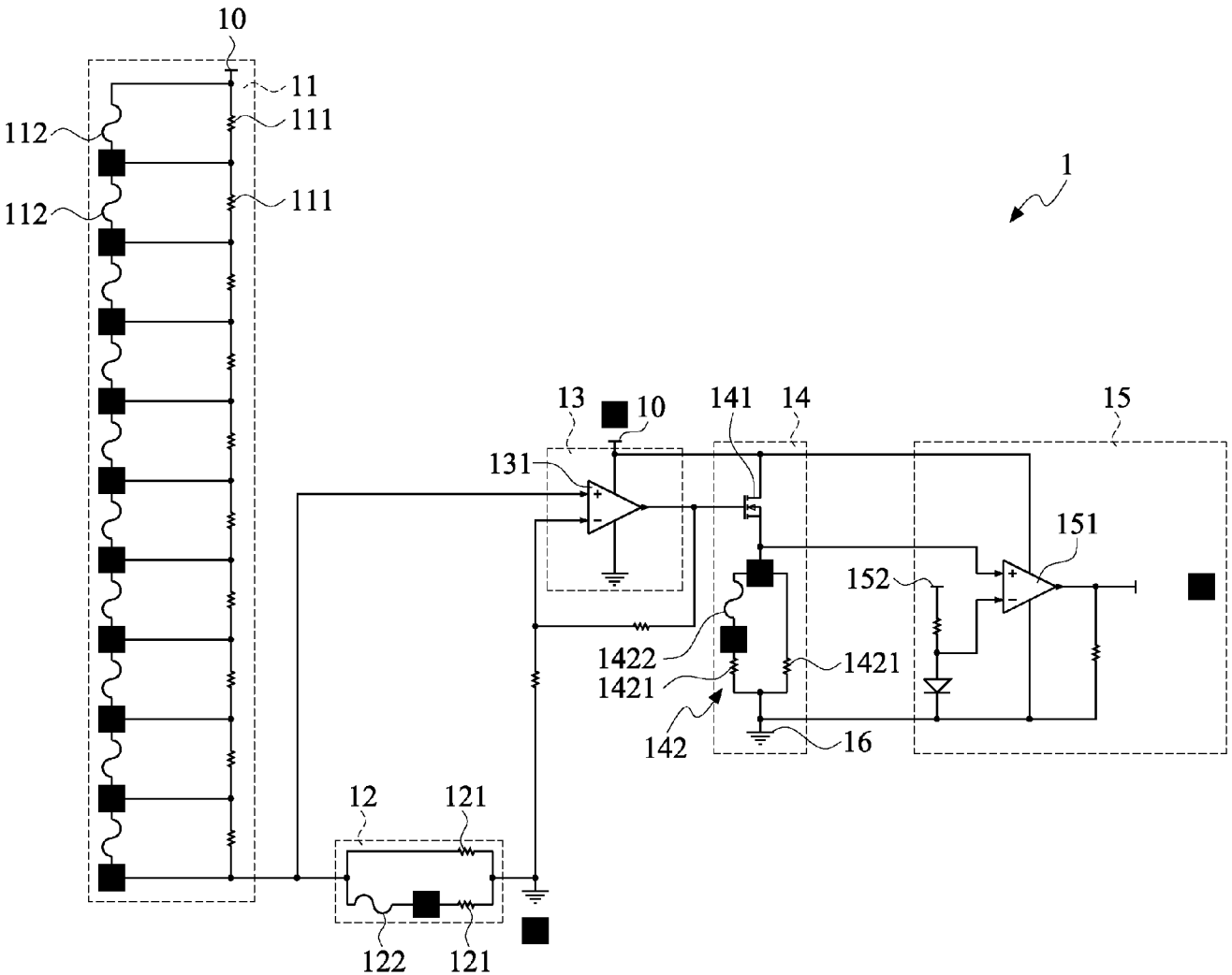
1
15
151
152
1421
16
14
141
142
1422
1421
10
13
131
121
121
12
122
11
111
111
10
112
112

VOLTAGE-MODULATED CIRCUIT DEVICE TO FORM ELECTRIC POWER WITH STEPPED-DOWN VOLTAGE

BACKGROUND OF THE INVENTION

1. Field of the Invention

The present invention relates to a voltage-modulated circuit device, more particularly to a circuit device using the value of a trigger voltage as a predetermined voltage value to trigger an electric conduction, and capable of modulating the voltage on the modulation circuit automatically, such that an electric power supplied to the circuit device is always maintained within a range of required voltage values.

2. Description of Related Art

Zener diode installed on an electronic circuit is generally used for modulating a voltage, and it plays an important role in applications of supplying a power source, like other rectifier diodes. The Zener diode is a P-N junction component made of silicon and differs from other rectifier diodes by its specific selection of using a reverse breakdown area. A breakdown voltage of the Zener diode is generally used in a manufacturing process for controlling a doping level, a diffusion time and an alloy junction temperature carefully to create a desired Zener voltage.

Although the Zener diode can be used for the modulation of a voltage, yet the modulated voltage value is a constant. If it is necessary to adjust the voltage value to a different range, many Zener diodes in different voltage ranges must be manufactured. Therefore, a large number of Zener diodes will be manufactured, particularly when the Zener diodes are purchased, approximately 200,000 pieces of Zener diodes are required for each purchased unit, and many useless ones (such as tens of thousands of them) are left over. Furthermore, the manufacture of Zener diodes requires a precise control of the doping level, diffusion time and alloy junction temperature and incurs a high defective rate, so that it is not easy to manufacture the Zener diodes in compliance with the range of the required voltages. Obviously, the prior art still has drawbacks and requires improvements.

SUMMARY OF THE INVENTION

In view of the aforementioned shortcomings of the conventional Zener diode, the inventor of the present invention based on years of experience in the related industry to conduct extensive researches and experiments, and finally developed a voltage-modulated circuit device in accordance with the present invention to overcome the shortcomings of the prior art.

Therefore, it is a primary objective of the present invention to provide a voltage-modulated circuit device capable of modulating a voltage of the circuit device according to a required voltage value.

To achieve the foregoing objective, the present invention provides a modulation circuit, and the modulation circuit comprises a voltage acquisition circuit, a step-down circuit, a voltage amplification circuit and a switch circuit, wherein the voltage acquisition circuit is formed by connecting a plurality of resistors with different resistances and a plurality of fuses in parallel, and using a portion of blown fuses to step down a voltage of the power source of the modulation circuit through a predetermined number of resistors to acquire a predetermined trigger voltage; the step-down circuit is electrically coupled to the voltage acquisition circuit and formed by connecting two resistors and a fuse in parallel and using a blown/not blown fuse to step down the trigger voltage by one of the resistors; the voltage amplification circuit is electrically coupled to the step-down circuit, and includes an amplifier for amplifying the stepped-down trigger voltage by three times; the switch circuit is electrically coupled to the voltage amplification circuit and includes a metal oxide semiconductor field effect transistor (MOSFET) and a current-down circuit, wherein the MOSFET can be triggered and conducted by the trigger voltage after it is amplified by several times, such that the power source of the modulation circuit can be passed from an anode to a cathode (or a ground terminal) to form an electric power with a voltage for the power supply purpose, and the current-down circuit is formed by connecting two resistors and a fuse in parallel and using a blown/not blown fuse to step down a current of the power source of the modulation circuit to a predetermined value (such as 5 mA, 20 mA) through one of the resistors. When use, the power source of the modulation circuit acquires a predetermined trigger voltage through the voltage acquisition circuit, and after the step-down circuit steps down the voltage, the voltage amplification circuit amplifies the voltage by three times, so that the trigger voltage amplified by three times still falling within the range of the predetermined voltage values can trigger and conduct the switch circuit, and the power source of the modulation circuit passing from the anode to the cathode forms an electric power with a stepped-down voltage for the power supply purpose. The voltage of the modulation circuit can be modulated automatically to maintain the electric power within the range of required voltage values, and the circuit device can be triggered and conducted, only if the trigger voltage has the predetermined voltage value.

The technical contents and effects of the present invention will become apparent with the detailed description of a preferred embodiment of the present invention together the illustration of a related drawing as follows.

BRIEF DESCRIPTION OF THE DRAWINGS

FIG. 1 is a schematic circuit diagram of the present invention.

DETAILED DESCRIPTION OF THE INVENTION

With reference to FIG. 1 for a voltage-modulated circuit device of the present invention, the voltage-modulated circuit device comprises a modulation circuit 1, and the modulation circuit 1 comprises a voltage acquisition circuit 11, a step-down circuit 12, a voltage amplification circuit 13 and a switch circuit 14, wherein the voltage acquisition circuit 11 is formed by connecting a plurality of resistors with different resistances 111 and a plurality of fuses 112 in parallel, and using a portion of blown fuses 112 to step down the voltage of a power source 10 of the modulation circuit 1 by a predetermined number of resistors 111 to acquire a predetermined trigger voltage.

The step-down circuit 12 is electrically coupled to the voltage acquisition circuit 11 and formed by connecting two resistors 121 and a fuse 122 in parallel, such that a blown/not blown fuse 122 can be used for stepping down the trigger voltage by one of the resistors 121.

The voltage amplification circuit 13 is electrically coupled to the step-down circuit, and includes an amplifier 131 for amplifying a stepped-down trigger voltage by several times (such as 3 times).

The switch circuit 14 is electrically coupled to the voltage amplification circuit 13 and includes a metal oxide semiconductor field effect transistor (MOSFET) 141 and a current-down circuit 142, wherein the MOSFET 141 can be triggered and conducted by the trigger voltage after being amplified by several times, so that the power source 10 of the modulation circuit can be passed from an anode to a cathode (or a ground terminal 16) through the MOSFET 141 to form an electric power with a voltage for the power supply purpose, and the current-down circuit 142 is installed on a path of the power source flowing from the anode to the cathode and formed by connecting two resistors 1421 and a fuse 1422 in parallel and using a blown/not blown fuse 1422 to step down a current of the power source 10 of the modulation circuit to a predetermined value (such as 5 mA, 20 mA) by one of the resistors 1421.

With the assembly of the foregoing components, the power source 10 of the modulation circuit acquires a predetermined trigger voltage through the voltage acquisition circuit 11. After the step-down circuit 12 steps down the voltage, the voltage amplification circuit 13 amplifies the voltage by several times, such that the trigger voltage amplified by several times still falls within the range of predetermined voltage values, then the MOSFET 141 of the switch circuit 14 will be triggered to conduct the switch circuit 14, so that the power source 10 of the modulation circuit can be passed from an anode to a cathode to form an electric power with a stepped-down voltage.

The circuit device will be triggered and conducted only if the trigger voltage has the predetermined voltage value, so that the voltage of the modulation circuit can be modulated automatically, and the electric power can be maintained within the range of the required voltage values.

With reference to FIG. 1, the modulation circuit 1 further comprises a compare circuit 15 electrically coupled to the switch circuit 14, and the compare circuit 15 comprises a comparator 151 for comparing the voltage of a referenced power source 152 with the voltage of the power source 10 of the modulation circuit, such that if the voltage of the power source 10 of the modulation circuit is too high, the comparator 151 will output a warning signal to an electronic device (not shown in the FIGURE) that is coupled to the compare circuit 15, and the electronic device will issue a warning to disconnect the power supply of the power source 10 of the modulation circuit, so as to protect the electronic circuit supplied with the power source 10.

If the voltage value of the trigger voltage is too small, then the MOSFET 141 of the switch circuit 14 cannot be triggered and conducted, so that the power source 10 of the modulation circuit will be unable to supply electric power. Now, the voltage of the power source 10 of the modulation circuit is too small, and the acquired predetermined trigger voltage is also too small. Therefore, the too-small voltage of the power source 10 of the modulation circuit cannot supply electric power to an electronic circuit to protect the electronic circuit.

If the value of the trigger voltage is too large, the MOSFET 141 of the switch circuit 14 will be burned or damaged, so that the power source 10 of the modulation circuit will be unable to supply electric power. Now, the voltage of the power source 10 of the modulation circuit is too large, and the acquired predetermined trigger voltage is also too large. Therefore, an electronic circuit supplied with the electric power can be protected by burning and damaging the MOSFET 141.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A voltage-modulated circuit device, having a modulation circuit, and the modulation circuit comprising:

a voltage acquisition circuit, formed by connecting a plurality of resistors with different resistances and a plurality of fuses in parallel, and using a portion of blown fuses to step down a voltage of a power source of the modulation circuit by a predetermined number of resistors to acquire a predetermined trigger voltage;

a step-down circuit, electrically coupled to the voltage acquisition circuit, and formed by connecting a first resistor and a first coupled resistor and fuse in parallel, and using a blown/not blown fuse to step down the trigger voltage by the first resistor or the resistor of the first coupled resistor and fuse;

a voltage amplification circuit, electrically coupled to the step-down circuit, and including an amplifier for amplifying a stepped-down trigger voltage by several times, wherein two inputs of the amplifier are connected to an input and an output of the step-down circuit, respectively;

a switch circuit, electrically coupled to the voltage amplification circuit, and including a metal oxide semiconductor field effect transistor (MOSFET) and a current-down circuit, wherein the MOSFET is triggered and conducted by the trigger voltage after being amplified by several times, and the current-down circuit is installed on a path from an anode to a cathode and formed by connecting a second resistor and a second coupled resistor and fuse in parallel, and using a blown/not blown fuse to step down a current of the power source of the modulation circuit to a predetermined value by the second resistor or the resistor of the second coupled resistor and fuse, such that if the trigger voltage amplified by several times falls within a range of predetermined voltage values, the MOSFET of the switch circuit is triggered to conduct the switch circuit, and the power source of the modulation circuit can be passed from the anode to the cathode through the MOSFET to form an electric power with a stepped-down voltage.

2. The voltage-modulated circuit device of claim 1, wherein the modulation circuit further comprises a compare circuit electrically coupled to the switch circuit, and the compare circuit comprises a comparator for comparing a voltage reference of a referenced power source with the voltage of the power source of the modulation circuit, such that if the voltage of the power source of the modulation circuit is too high, the comparator will output a warning signal to an electronic device coupled to the compare circuit, and the electronic device will send a warning to disconnect a power supply of the power source of the modulation circuit to protect the electronic device supplied with the power source.

* * * * *